United States Patent [19]

Asselman et al.

[11] 3,943,964

[45] Mar. 16, 1976

[54] HEATING DEVICE

[75] Inventors: George Albert Apolonia Asselman; Adrianus Petrus Dirne; Petrus Helena Gerardus Maria Vromans, all of Eindhoven, Netherlands

[73] Assignee: U.S. Philips Corporation, New York, N.Y.

[22] Filed: Dec. 19, 1974

[21] Appl. No.: 534,621

Related U.S. Application Data

[63] Continuation of Ser. No. 159,205, July 2, 1971, abandoned.

[30] Foreign Application Priority Data

July 7, 1970 Netherlands ..... 7009990

[52] U.S. Cl. ..... 137/334; 165/105; 137/13; 432/91

[51] Int. Cl. ..... F28d 15/00; F27b 17/00

[58] Field of Search ..... 165/105; 432/90, 91

[56] References Cited

UNITED STATES PATENTS

| | | | |
|---|---|---|---|
| 3,435,889 | 4/1969 | Bienert | 165/105 |
| 3,613,778 | 10/1971 | Feldman, Jr. | 165/105 |
| 3,651,240 | 3/1972 | Kirkpatrick | 165/105 X |
| 3,658,125 | 4/1972 | Freggins | 165/105 X |

*Primary Examiner*—Albert W. Davis, Jr.
*Attorney, Agent, or Firm*—Frank R. Trifari; J. David Dainow

[57] ABSTRACT

A heating device formed as a double-wall tubular heat pipe with a closed annular space between outer and inner walls containing a vaporizable liquid heat-transporting medium, and a cylindrical bore defined within said inner tube as the heating space for objects to be heated, said annular space having end walls closing its ends, and means for transmitting heat through one of said end walls into said space.

6 Claims, 7 Drawing Figures

INVENTORS
GEORGE A.A. ASSELMAN
ADRIANUS P. DIRNE
PETRUS H.G.M. VROMANS
BY
AGENT

INVENTORS
GEORGE A.A. ASSELMAN
ADRIANUS P. DIRNE
PETRUS H.G.M. VROMANS
BY
AGENT

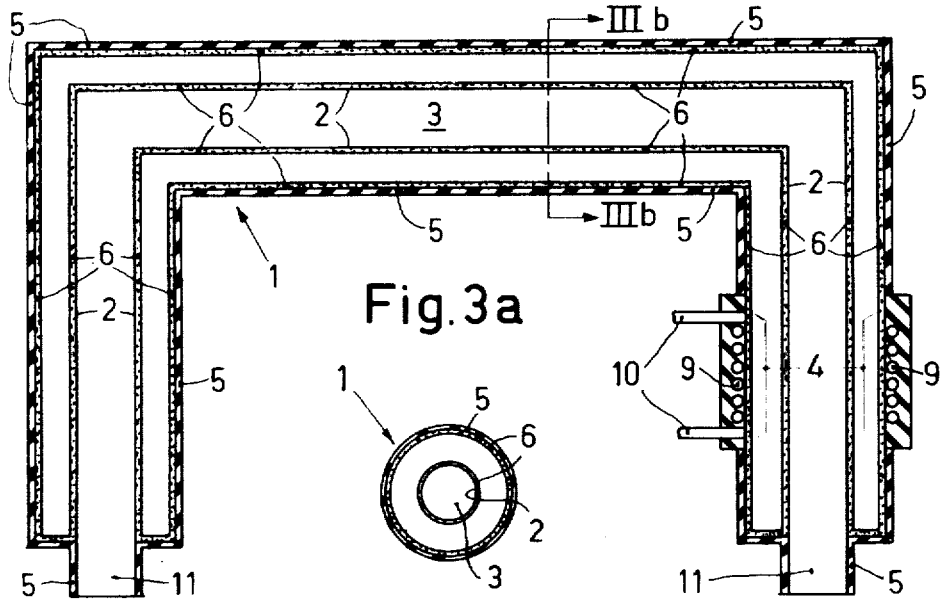
Fig.3a
Fig.3 b
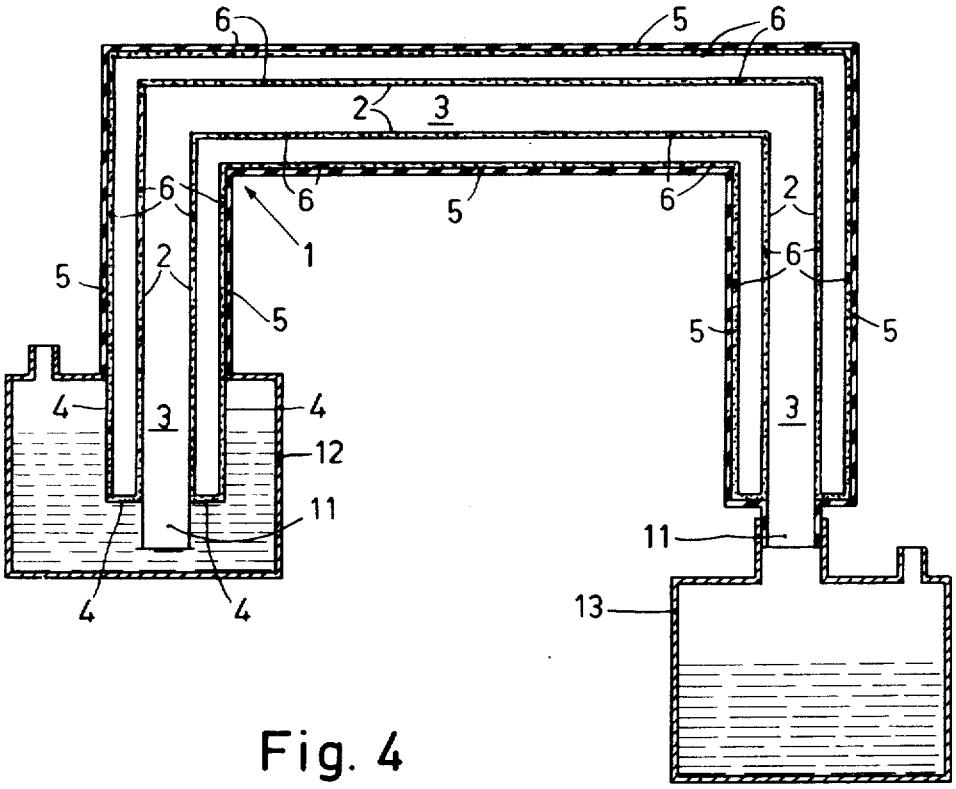
Fig. 4
INVENTORS
GEORGE A.A. ASSELMAN
ADRIANUS P. DIRNE
PETRUS H.G.M. VROMANS
BY
AGENT

HEATING DEVICE

This is a continuation of application Ser. No. 159,205, filed July 2, 1971, now abandoned.

BACKGROUND OF THE INVENTION

The invention relates to a heating device having a heating space which is accessible for objects to be heated inside said space and to which space thermal energy from at least one heat source can be supplied.

Devices of this type are known and are used for a great variety of purposes. They are used, for example, to dry lacquered objects, to bake layers of (ceramic) material, to keep molten materials at the desirable temperature during their transport through a duct so as to prevent solidification of the liquid in the transport duct, to keep molten glass at the desirable temperature during drawing glass in the form of tubes or rods, to heat wire material, for example tungsten, before it enters the die, and so on.

In practice the heat sources are usually constituted by electric resistance wires heated by the passage of current (see, for example, Dutch Pat. No. 34,607 and U.S. Pat. No. 3,063,268) or gas burners (see, for example, U.S. Pat. No. 3,253,898 and the published French patent application No. 2,007,949).

The known heating devices have several drawbacks. In many manufacturing processes it is of great importance that the temperature in the heating space should have the same value everywhere, in particular when, in addition to the thermal treatment, the objects have to be subjected to other treatments in the heating space, for example, the bending of glass sheets, described in the above U.S. Pat. No. 3,253,898. A non-uniform temperature in the heating space results in stresses in the material, as a result of which fracture and a high reject percentage occur, which therefore is undesirable. Isothermal surroundings are also of great importance in all kinds of measurements, for example in the calibration of thermocouples in a calibrating furnace. In order to obtain the heating space in heating devices which are provided with electric resistance wire heating as isothermal as possible, the wires are wound around the heating space throughout the length of the device, and thermally insulated from the atmosphere as readily as possible. In particular in the case of long transit spaces, this makes the construction of the heating device complicated and expensive. In addition, at the beginning and at the end of the transit space, the thermal losses are always larger than in the center and therefore the temperatures are lower at those regions. In order to compensate for this as much as possible, new structural measures are required, for example, winding the resistance wire at the beginning and at the end of the transit space with a smaller pitch than in the In heating devices employing gas heating, as described in the above U.S. Pat. No. 3,253,898, the isothermal character of the transit space is endeavoured by arranging a large number of gas burners in said space. This also makes the device complicated and expensive. The same applies to heating devices in which a large number of filament lamps, especially those constructed as infrared radiators, are mounted. Furthermore, a separate control for each gas burner and infrared radiator, respectively, is required for the temperature adjustment of the heating space.

It is the object of the present invention to provide a heating device of a simple and inexpensive construction and of which the heating space is isothermal during operation throughout its dimensions.

Summary of the Invention

In order to realize this object, the heating device according to the invention is characterized in that the boundary of the heating space is formed by at least a first heat transmission wall which, with its side remote from the heating space, constitutes a part of the boundary of a closed container. In the container a heat transporting medium is present. Thermal energy is absorbed by the medium from the heat source through a second heat transmission wall at another area of said container. The medium changes from the liquid phase into the vapor phase, and supplies thermal energy to the heating space through the first heat transmission wall while changing from the vapor phase into the liquid phase. The container has a porous mass which connects the first heat transmission wall to the second heat transmission wall in such manner that, due to capillary action, heat transporting medium condensed on the heat transmission wall can flow back to the further heat transmission wall through said mass.

Liquid heat transporting medium which evaporates in the second heat transmission wall moves in the vapor phase to the heat transmission wall as a result of the lower vapor pressure which prevails there due to the comparatively low temperature at that region. The vapor then condenses on the heat transmission wall while supplying the heat of evaporation to the said wall, after which the condensate is returned, via the porous mass, due to capillary action while using the surface tension of the condensate, to the further heat transmission wall to be evaporated there again. Since the vapor always condenses at the region where the lowest vapor pressure prevails, a locally different temperature will immediately be compensated for so that the heat transmission wall has the same temperature everywhere.

Due to the comparatively high heat of evaporation of liquids, a large quantity of thermal energy can be stored in the vapor and be transported per unit of time from the second heat transmission wall to the first heat transmission wall, while a good heat transmission is ensured between the liquid and the heat transmission wall by condensation. Due to the large heat dissipating capacity of the heat transporting medium it is possible to achieve, by heating of a further heat transmission wall of small dimensions, that, through the process of evaporation-condensation, a heat transmission wall of large dimensions is heated to a uniform temperature. This provides the advantage that at the region of the second heat transmission wall of small area only one heating element, for example, a heating coil or a gas burner, will be sufficient, as a result of which the device is much simpler and cheaper than the known devices having heating wires wound throughout the length of burners, respectively. A number of heating devices can now be operated simultaneously with one and the same heating element, while in all cases only one temperature control device will be sufficient.

Due to the already mentioned large heat transporting capacity of the medium in the container, there exists substantially no temperature drop between the second heat transmission wall and the first heat transmission wall. So the latter will assume a temperature which is substantially equal to the temperature of the second heat transmission wall. This provides more and better possibilities of temperature measurements during operation of the device. Only one temperature sensor is sufficient which can be arranged at any place.

As a result of the presence of the porous mass, the return of condensate from the heat transmission wall to the further heat transmission wall is ensured in all circumstances, so even return against gravity or without the effect of gravity. Therefore, the heating device is independent of position, which provides a large freedom of arrangement.

The porous mass may be, for example, ceramic materials, gauzes of wire or tape-shaped material of metals or of metal alloys, or an arrangement of pipes. Among the possibilities is also a system of grooves in the wall of the container combined or not combined with one of the other above alternatives.

The choice of the heat transporting medium is determined in the first instance by the operating temperature in the heating space. When this temperature lies in the region of from 600° to 1500° C, sodium, for example, may be chosen. Also to be considered are, for example, the metals potassium, lithium, cadmium, cesium, metal salts such as the metal halogens zinc chloride, aluminium bromide, cadmium iodide, calcium iodide, zinc bromide or mixtures thereof, nitrates and nitrites or mixtures thereof.

The choice of the material of the container of course depends upon the operating temperature and the heat transporting medium chosen. When sodium is used, for example, chromium-nickel steel is to be considered.

The container with the heating space may have all kinds of shapes and may be, for example, a hollow cylinder with two coaxial tubes, the innermost of which constitutes the first heat transmission wall and a part of the surface of the outermost tube constitutes the second heat transmission wall, the remaining parts of the wall of the closed annular space between the said two tubes being thermally insulated from the atmosphere.

The porous mass connecting the first heat transmission walls to the second heat transmission wall may cover a larger or smaller part of the surface of the wall of the container.

In a favourable embodiment of the heating device according to the invention, however, the porous mass covers the whole surface of the wall of the container. This provides the following advantages. Since in the present case the porous mass covers the entire second heat transmission wall, said wall will be wetted evenly by condensate. This reduces the danger of local overheating of said wall. In the first heat transmission wall the porous mass promotes that the side of the first heat transmission wall remote from said mass has a uniform temperature. This is the result of the fact that the porous mass prevents local formation of drops under the influence of the effect of gravity. Formation of drops on one side of the heat transmission wall results in locally higher thermal resistance, as a result of which a deviating temperature occurs on the other side of said wall.

In order that the process of evaporation-condensation of the heat transporting medium in the container can occur readily, said container is normally evacuated. A problem is that in a number of cases, dependent upon the heat transporting medium chosen, the vapor pressure of the heat transporting medium in the container lies below the ambient pressure not only at room temperature, but also at the high operating temperature of the heating device. For example, if sodium is used as a heat transporting medium in the evacuated container, the vapor pressure at 800° K is 8 Torr (1 Torr = 1 mm mercury pressure) and at 1100° K is 450 Torr. This means that, in particular in containers of large dimensions having large flat walls, these walls are subjected to a considerable mechanical load as a result of the atmospheric pressure, which load will even be larger when the heating device constitutes a component of a larger construction and other structural components exert forces on the container, for example, by their own weight. Notably at high operating temperatures, at which the rigidity of the container walls is considerably lower than at room temperature, this results in deformation (sagging) and tearing, respectively, of the container walls with a danger of implosion.

The porous mass may work loose from the wall of the container and/or its capillary structure may be damaged so that it can no longer be used for the return of condensate.

The choice of thicker and consequently more rigid container walls often is not possible for reasons of weight, cost-price or permissible dimensions, while the heat transmission walls are moreover restricted to certain thickness limits in connection with the thermal resistance.

In order to avoid the said drawbacks in a simple and cheap manner, a favorable embodiment of the heating device according to the invention is characterized in that one or more supporting elements are arranged in the container to support the container walls against pressure forces exerted thereon from without, said supporting elements permitting flow of medium vapor in the direction of heat transport.

Since the container walls are supported now, they will maintain their original shape and tearing of the walls, implosion or damage to the capillary structure of the porous mass is prevented. Should, normally, the possibility exist that, as a result of thermal stresses between the container walls and the porous mass or due to shocks or vibrations, said porous mass should work loose from the wall, the supporting elements will now also ensure that the porous mass remains in its place.

The supporting elements may be constituted, for example, by perforated metal plates, which are or are not connected together, by metal gauzes, folded in a zig-zag manner or by a structure of rods or pipes.

In a further favorable embodiment of the heating device according to the invention the supporting elements are constituted by a compressed porous filling mass of wire or tape-shaped material, the pores of which have such a size that the relationship $$\frac{2\,\gamma\cos\Theta}{R} - \Delta p - \rho g h > \frac{2\,\gamma\cos\Theta}{R_1}$$

is satisfied, in which $\gamma$ = surface tension of liquid heat transporting medium, R = hydraulic radius of the pores in the porous mass.

$\Theta$ = angle of contact of liquid heat transporting medium in the pores of the porous mass, $R_1$ = hydraulic radius of the pores in the filling mass, $\Theta_1$ = angle of contact of liquid heat transporting medium in the pores of the filling mass, $\Delta_p$ = pressure loss of liquid heat transporting medium in the porous mass between the heat transmission wall and the further heat transmission wall as a result of the resistance to flow of said mass, $\rho$ = density of liquid heat transporting medium $g$ = acceleration of gravity, $h$ = difference in height between second heat transmission wall first and heat transmission wall.

The container can be filled with such a filling mass in a simple and cheap manner. The wires or tapes may be arranged in the container in bulk and then be compressed — which is of advantage in containers in which certain parts of the space inside are difficult of access — for the compression, followed or not followed by sintering, may be carried out previously.

The left-hand term of the above relationship represents the resulting capillary force on liquid heat transporting medium in the porous mass, the hydraulic radius R being defined as $$2. \frac{\text{surface}}{\text{circumference}}$$

of the pores.

The angle of contact $\Theta$, namely the angle between the liquid surface and the wall of the pore, depends for a given liquid on the material of the wall of the pore and the nature of the wall surface. If in the present case the material of the porous filling mass is different from the porous mass, the capillary rise with the same hydraulic radius may be mutually different.

By ensuring that the above relationship is fulfilled, the porous mass will have a drawing effect for liquid which is so much larger than that of the filling mass that at the area of the heat transmission wall all the condensate is absorbed by the porous mass and nothing by the filling mass, while also in the direction from the first heat transmission wall to the second heat transmission wall condensate will not pass from the porous mass to the filling mass.

Consequently, transport of vapor from the further heat transmission wall to the heat transmission wall through the filling mass takes place substantially without hindrance.

All this means in practice, that the pores of the filling mass have a larger hydraulic radius than the pores of the porous mass. Comparatively large dimensions of the pores of the filling mass are also desirable to minimize the flow losses of the vapor and hence the gradient between the two heat transmission walls.

According to the invention, steel wool is preferably used as a material for the filling mass. Steel wool presents the advantage of a low price, can easily be compressed in all kinds of shapes and, in the compressed condition, can receive considerable surface pressures.

In order that the invention may be readily carried into effect, four embodiments of the heating device will now be described in greater detail, by way of example, with reference to the diagrammatic drawings, which are not drawn to scale.

BRIEF DESCRIPTION OF THE FIGURES

FIGS. 3*a* and 3*b* and 4 show heating devices which form an integral part of a transport duct for readily solidifiable liquids.

DESCRIPTION OF THE PREFERRED EMBODIMENT

Figure 1A:
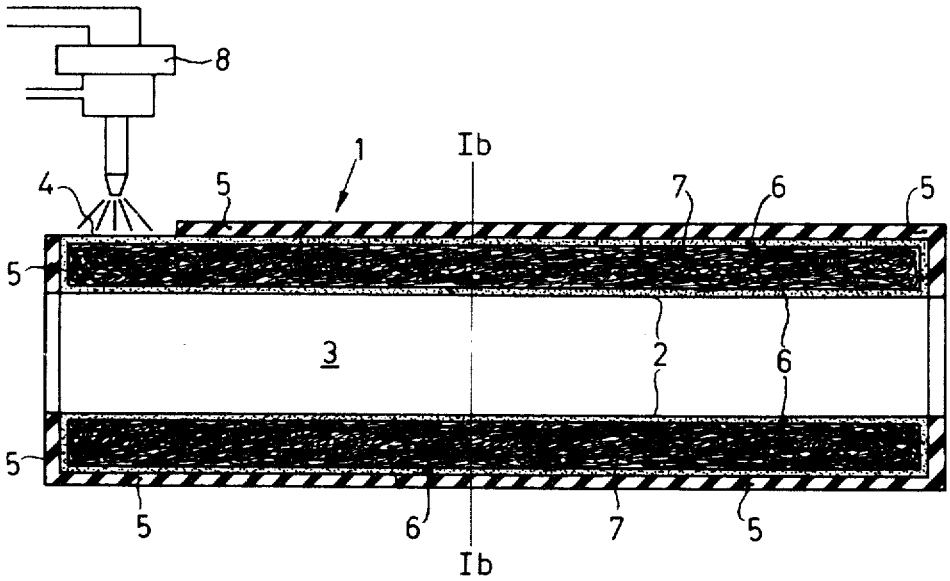
FIGS. 1*a* and 1*b* show a heating device constructed as a tunnel furnace.
Figure 1B:
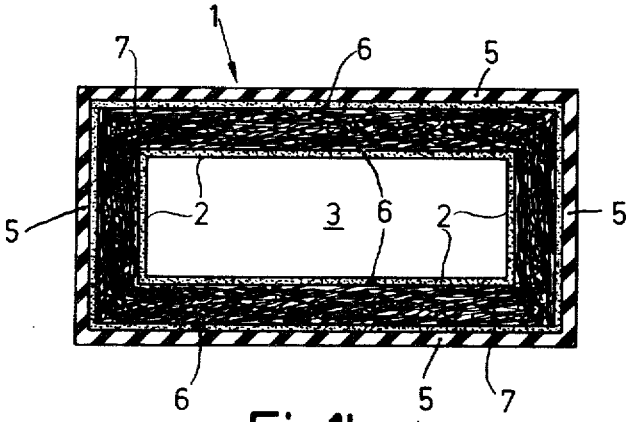

Referring now to FIG. 1, reference numeral 1 denotes a closed container which is shown as a longitudinal cross-sectional view (FIG. 1*a*) and as a cross-sectional view (FIG. 1*b*) taken on the line I*b*—I*b* of FIG. 1*a*, respectively. The container comprises a first heat transmission walll 2 which bounds a heating space 3 (transit space) for objects to be heated which us open at either end and comprises a second heatt transmission wall 4, the area of which is only a fraction of that of the first heat transmission wall 2. For the rest the container 1 is thermally insulated from the atmosphere by means of insulation material 5.

The inner walls of the container 1 are covered with a porous mass 6 which has a capillary structure, while the container is furthermore filled with a compressed and porous filling mass 7 having pores the cross-sections of which are larger than those of the pores in the mass 6. The porous filling mass 7 in this case consists of steel wool.

The container 1 furthermore comprises a suitably chosen quantity of sodium as a heat transporting medium. Thermal energy can be supplied to the second heat transmission wall 4 by means of a burner 8.

The operation of the heating device is as follows. During operation of the device, liquid sodium evaporates at the region of the second heat transmission wall 4 by the absorption of thermal energy from the burner 8, through the said heat transmission wall 4. The sodium moves in the vapor phases through the porous mass 7 to the heat transmission wall 2 as a result of the lower vapour pressure prevailing near the said wall due to the slightly lower temperature at that region. The sodium vapor then condenses on the heat transmission wall 2, while supplying the heat of evaporation to said wall, after which the condensate is returned, via the porous mass 6, by capillary action and while using the surface tension of the condensate, to the second heat transmission wall 4 to be evaporated there again. The return of condensate is possible in this case irrespective of the position of the heating device, so even against gravity or without the effect of gravity. Since the pores in the porous mass 6 have smaller cross-sections than the pores in the filling mass 7 and consequently exert a larger drawing force, all the condensate at the area of the heat transmission wall 2 will be absorbed in the pores of the mass 6 and nothing in the filling mass 7. So all the pores in the filling mass 7 remain available for the transport of sodium vapor from the second heat transmission wall 4 to the heat transmission wall 2.

Heat transmission wall 2 will automatically assume the same temperature throughout its surface. Actually, the vapor always condenses where the lowest pressure prevails so that the locally different temperature is immediately corrected. Therefore we have a completely isothermal heating space 3.

Due to the large heat transporting capacity of sodium vapor, heat transmission wall 2, of large area, is heated to a uniform temperature by heating the second heat transmission wall 4, of small area, with only one burner 8.

Also due to the said large heat transporting capacity of sodium vapor there is substantially no temperature drop between the heat transmission walls 2 and 4. Therefore, temperature measurement can be effected at the heat transmission wall 2, instead of in a large number of places in the heating space 3, as has been usual so far. For controlling the temperature of the heating device it is sufficient to control only the burner 8.

As a result of the process of evaporation-condensation of the sodium, a good heat transmission between liquid sodium and the two heat transmission walls is ensured. The container 1 is evacuated in order that the process of evaporation-condensation of the sodium can run off smoothly. The vapor pressure of the sodium both at room temperature and at an operating temperature of, for example, 600° C, is much lower than 1 atmosphere. Therefore, large pressure forces are exerted by the atmosphere especially on the upper and lower walls of the container with their large areas.

The porous filling mass 7 serves as a supporting element which receives the pressure forces exerted from without on the container wall and ensures that the container walls do not sag, tear and implode, respectively, or cause damage to the porous mass 6, so that the capillary structure of the last-mentioned mass can no longer be used.

Figure 2A:
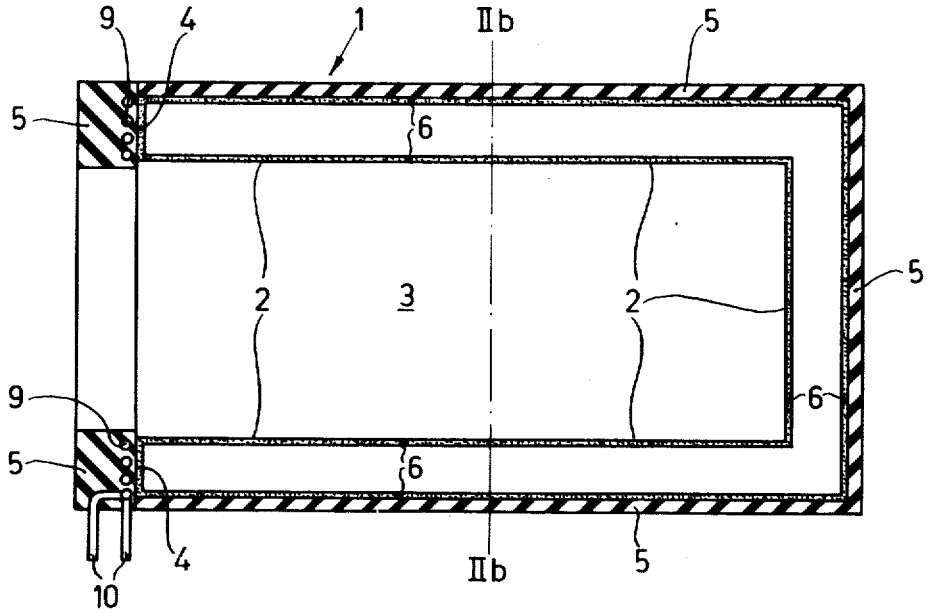
FIGS. 2*a* and 2*b* show a heating device constructed as a furnace closed on one side
Figure 2B:
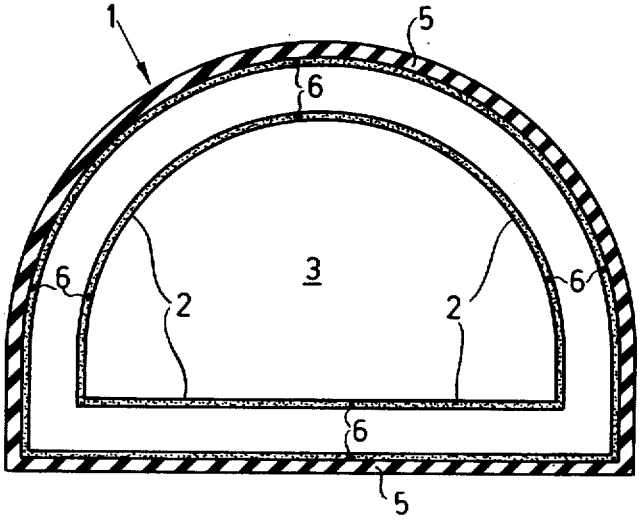

In the furnace shown in FIG. 2 which is closed at one end, components corresponding to FIG. 1 are referred to by the same reference numerals. FIG. 2*a* is a longitudinal cross-sectional view of the furnace and FIG. 2*b* is a cross-sectional view taken on the line II*b*—II*b* of FIG. 2*a*.

In these Figures, supporting elements for supporting the container walls against pressure forces from without are not shown. In furnaces having small dimensions and mechanically comparatively strong cylindrical or semicylindrical container walls, said elements are not always necessary either at low vapour pressures of the heat transporting medium.

Container 1 again comprises a heat transporting medium which, in a manner identical to that of the tunnel furnace shown in FIG. 1, performs a cycle of evaporation-condensation, so that the description of the operation of the furnace may further be omitted.

The heat source in this embodiment is an electric heating coil 9 which is thermally insulated from the atmosphere and the ends of which can be connected to a source of electrical energy.

By heating the small annular second heat transmission wall 4 near the entrance of the furnace by means of the heating coil 9 the entire heat transmission wall 2 of the furnace assumes a uniform temperature. The furnace thus is entirely isothermal.

In FIGS. 3 and 4, in which for corresponding components the same reference numerals are used as in the preceding Figures, the container has an annular cylindrical construction and forms part of a liquid transporting duct 11.

FIG. 3*a* is a longitudinal cross-sectional view of the liquid transporting duct and FIG. 3*b* is a cross-sectional view taken on the line III*b*—III*b* of FIG. 3*a*. The second heat transmission wall 4 in this case is constituted by a part of the annular cylindrical outer wall to which thermal energy can be supplied by the heating coil 9 as a result of which the complete annular cylindrical inner wall, namely the heat transmission wall 2, assumes an isothermal temperature as a result of the cycle of evaporation-condensation of the heat transporting medium present in the container 1. When the operating temperature is slightly above the solidification point of the liquid transported through the heating space 3, there will nowhere throughout the transporting track exist the danger of liquid solidifying and local clogging of the duct occurring, since the temperature of the heat transmission wall 2 is the same everywhere.

The device shown in FIG. 4 in general is equal to that shown in FIG. 3. In this device, the second heat transmission wall 4 is present on the left-hand end of the liquid duct and arranged in a liquid container 12 which communicates with a storage container 13 via the liquid duct 11.

If, for example, the liquid container 12 comprises lithium fluoride, LiF (solidification point approximately 848° C) which is to be transported to the storage container 13, which may be effected, for example by siphoning effect, the heat transporting medium in the container 1, for example sodium, will absorb thermal energy from the LiF bath through the second heat transmission wall 4. The process of evaporation-condensation of sodium already described, then again occurs within the container 1 so that the heat transmission wall 2 again assumes a uniform temperature throughout its surface. Liquid LiF flowing through the space 3 can not solidify within the liquid duct 11. Liquid transporting duct 11 itself now requires no heating coil. Of course, liquid container 12 should be kept at the desirable temperature.

Of course all kinds of other embodiments are possible within the scope of this invention in addition to the embodiments described. The heating device according to the invention may advantageously be used for all kinds of purposes including these mentioned already in the introduction. Notably the use in glass technology (manufacture and processing of glass) is interesting.

For example, the device shown in FIG. 2 may serve on the one hand as a tank furnace, as a melting tank for glass and on the other hand as a storage container in which molten glass is maintained at a given temperature. The storage container may be connected to the melting tank via a transporting duct for liquid glass having a construction according to that shown in FIGS. 3 or 4. A glass-processing device, for example, for drawing glass in the form of rods or tubes, as described, for example, in U.S. Pat. No. 3,063,268, may in turn be connected to the storage container, likewise via such a duct. The outflow aperture of the said drawing device may be in agreement with a construction which corresponds to that of FIG. 1 of the present application.

What is claimed is:

1. A furnace operable with a heat source and providing an isothermal heating chamber comprising first and second tubes, the first tube situated within the second with an annular space having first and second ends defined between the walls of said tubes and a bore defined within the first tube, and walls closing said ends of the annular space and sealing same, a vaporizable liquid heat-transporting medium within said annular space, said tube walls and end walls having inner surfaces defining said chamber, and having outer surfaces, said furnace further comprising capillary material on said inner surfaces, and compressed porous filling material within said chamber and supporting said tube walls from compression, said filling material and capillary material having pores, the hydraulic diameter of the filling material pores being greater than that of said capillary material, one portion of said outer surface being a heat transmission wall for receiving heat from said heat source, and said furnace being operable as a heat pipe.

2. A furnace according to claim 1 further comprising closure means closing one end of said bore.

3. A furnace according to claim 2 wherein said closure means is formed by walls defining a passage therethrough which communicates with said annular space, said passage walls further comprising capillary material thereon similar to and contiguous with said capillary material on said inner surfaces of said chamber walls.

4. Apparatus according to claim 1 wherein said porous material comprises steel wool.

5. Apparatus according to claim 1 wherein said heat source comprises a first container for containing liquid, the apparatus being operable with a second container for receiving and storing said liquid, and said first tube bore comprises a liquid transfer line having first and second ends, said heat transmission wall and first end of the liquid transfer line extend into said first container for contacting and receiving heat from liquid therein and for communicating said liquid to said second container, said transfer line being said isothermal furnace.

6. A heating device as claimed in claim 1, characterized in that the supporting means comprises a compressed porous filling mass of wire or tape-shaped material, the pores of which have such a size that the relationship $$\frac{2\,\gamma \cos \Theta}{R} - \Delta p - \rho g h > \frac{2\,\gamma \cos \Theta_1}{R_1}$$

is satisfied, in which $\gamma$ = surface tension of liquid heat transporting medium R = hydraulic radius of the pores in the porous mass.

$\eta$ = angle of contact for liquid heat transporting medium in the pores of the porous mass, $R_1$ = hydraulic radius of the pores in the filling mass, $\eta_1$ = angle of contact for liquid heat transporting medium in the pores of the filling mass, $\Delta_p$ = pressure loss of liquid heat transporting medium in the porous mass between the heat transmission wall and the further heat transmission wall as a result of the resistance to flow of said mass, $\rho$ = density of liquid heat transporting medium, $g$ = acceleration of gravity.

$h$ = difference in height between further heat transmission wall and heat transmission wall.

* * * * *

UNITED STATES PATENT AND TRADEMARK OFFICE

CERTIFICATE OF CORRECTION

PATENT NO. : 3,943,964

DATED : March 16, 1976

INVENTOR(S) : GEORGE ALBERT APOLONIA ASSELMAN ET AL

It is certified that error appears in the above-identified patent and that said Letters Patent are hereby corrected as shown below:

Col. 8, line 54, after "tube", delete "and" and insert --end--

Signed and Sealed this

Seventh Day of December 1976

[SEAL]

*Attest:*

RUTH C. MASON
*Attesting Officer*

C. MARSHALL DANN
*Commissioner of Patents and Trademarks*